US010145524B2

(12) United States Patent
Jurik et al.

(10) Patent No.: US 10,145,524 B2
(45) Date of Patent: Dec. 4, 2018

(54) DUAL GRAPHIC WHEEL FOR AN AUTOMATED LUMINAIRE

(71) Applicant: Robe Lighting s.r.o., Roznov pod Radhostem (CZ)

(72) Inventors: Pavel Jurik, Prostredni Becva (CZ); Josef Valchar, Prostredni Becva (CZ)

(73) Assignee: Robe Lighting s.r.o, Roznov pod Radhostem (CZ)

( * ) Notice: Subject to any disclaimer, the term of this patent is extended or adjusted under 35 U.S.C. 154(b) by 0 days.

(21) Appl. No.: 15/712,961

(22) Filed: Sep. 22, 2017

(65) Prior Publication Data

US 2018/0135820 A1 May 17, 2018

Related U.S. Application Data

(63) Continuation of application No. 14/495,856, filed on Sep. 24, 2014, now abandoned, which is a continuation of application No. 13/438,841, filed on Apr. 3, 2012, now abandoned.

(60) Provisional application No. 61/471,683, filed on Apr. 4, 2011.

(51) Int. Cl.

| | |
|---|---|
| ***F21S 10/00*** | (2006.01) |
| ***F21V 11/08*** | (2006.01) |
| *F21W 131/406* | (2006.01) |

(52) U.S. Cl.

CPC ..... *F21S 10/007* (2013.01); *F21V 11/08* (2013.01); *F21W 2131/406* (2013.01)

(58) Field of Classification Search

USPC ..... 362/282, 283, 284

See application file for complete search history.

(56) References Cited

U.S. PATENT DOCUMENTS

| | | | |
|---|---|---|---|
| 4,037,097 | A | 7/1977 | Stillman et al. |
| 4,618,918 | A | 10/1986 | Zhabokrug |
| 5,113,332 | A | 5/1992 | Richardson |
| 5,416,681 | A | 5/1995 | Wu |
| 6,726,333 | B2 | 4/2004 | Huibers et al. |
| 7,050,120 | B2 | 5/2006 | Allen et al. |
| 7,283,181 | B2 | 10/2007 | Allen et al. |
| 7,905,630 | B2 | 3/2011 | Dalsgaard |
| 8,684,561 | B2 | 4/2014 | Quadri et al. |
| 2003/0076681 | A1 | 4/2003 | Rasmussen et al. |
| 2009/0303723 | A1 | 12/2009 | Cavenati et al. |
| 2013/0094219 | A1 | 4/2013 | Jurik et al. |
| 2016/0084457 | A1 | 3/2016 | Jurik et al. |

FOREIGN PATENT DOCUMENTS

| | | | |
|---|---|---|---|
| EP | 0442169 | A2 | 8/1991 |
| EP | 1079174 | A1 | 2/2001 |
| WO | 2011119450 | A1 | 9/2011 |

OTHER PUBLICATIONS

Office Action dated Aug. 5, 2013; U.S. Appl. No. 13/438,841, filed Apr. 3, 2012; 5 pages.

(Continued)

*Primary Examiner* — Laura Tso

(74) *Attorney, Agent, or Firm* — Conley Rose, P.C.; Grant Rodolph; Brooks W Taylor

(57) ABSTRACT

An automated luminaire with dual over-sized graphic wheels that can be inserted and positioned into or out of the light path of the luminaire together as a unit and each graphic wheel can be rotated independent of the other wheel.

19 Claims, 12 Drawing Sheets

(56) References Cited

OTHER PUBLICATIONS

Final Office Action dated Mar. 24, 2014; U.S. Appl. No. 13/438,841, filed Apr. 3, 2012; 5 pages.
Office Action dated Jan. 15, 2016; U.S. Appl. No. 14/495,856, filed Sep. 24, 2014; 8 pages.
Office Action dated Aug. 26, 2016; U.S. Appl. No. 14/495,856, filed Sep. 24, 2014; 5 pages.
Notice of Allowance dated Mar. 10, 2017; U.S. Appl. No. 14/495,856, filed Sep. 24, 2014; 5 pages.
Corrected Notice of Allowance dated Jun. 16, 2017; U.S. Appl. No. 14/495,856, filed Sep. 24, 2014; 5 pages.
PCT International Search Report; Application No. PCT/US2012/032185; dated Nov. 16, 2012; 4 pages.
PCT Written Opinion of the International Searching Authority; Application No. PCT/US2012/032185; dated Nov. 16, 2012; 4 pages.
Chinese Office Action; Application No. 201280021667.9; dated Apr. 8, 2015; 9 pages.
Chinese Office Action; Application No. 201280021667.9; dated Dec. 9, 2015; 9 pages.
Chinese Notification to Grant Patent Right; Application No. 201280021667.9; dated Aug. 16, 2016; 3 pages.
European Intention to Grant; Application No. 12759839.9; dated Apr. 4, 2016; 6 pages.
Notice of Allowance dated Jun. 27, 2018; U.S. Appl. No. 14/495,856, filed Sep. 24, 2014; 12 pages.

DUAL GRAPHIC WHEEL FOR AN AUTOMATED LUMINAIRE

CROSS-REFERENCE TO RELATED APPLICATIONS

This application is a continuation of U.S. patent application Ser. No. 14/495,856, filed Sep. 24, 2014 by Pavel Jurik, et al. entitled, "Dual Graphic Wheel for an Automated Luminaire", which is a continuation of U.S. patent application Ser. No. 13/438,841, filed Apr. 3, 2012 by Pavel Jurik, et al. entitled, "Dual Graphic Wheel for an Automated Luminaire", which claims priority to U.S. Provisional Application No. 61/471,683 filed Apr. 4, 2011 by Pavel Jurik, et al. entitled, "Dual Graphic Wheel for an Automated Luminaire".

TECHNICAL FIELD OF THE INVENTION

The invention relates to equipment for the selection and movement of images or gobos within an automated luminaire.

BACKGROUND OF THE INVENTION

Luminaires with automated and remotely controllable functionality are well known in the entertainment and architectural lighting markets. Such products are commonly used in theatres, television studios, concerts, theme parks, night clubs, and other venues. A typical product will commonly provide control over the pan and tilt functions of the luminaire allowing the operator to control the direction the luminaire is pointing and thus the position of the light beam on the stage or in the studio. Typically, this position control is done via control of the luminaire's position in two orthogonal rotational axes usually referred to as pan and tilt. Many products provide control over other parameters such as the intensity, color, focus, beam size, beam shape, and beam pattern. The beam pattern is often provided by a stencil or slide called a gobo which may be a steel, aluminum, or etched glass pattern. The products manufactured by Robe Show Lighting such as the ColorSpot 700E are typical of the art.

Such gobos are typically the size of the luminaire's optical aperture and systems may be provided to select between different gobos, often mounted on a wheel, or to rotate a gobo once selected. The optical systems of such luminaires may further include gobos, patterns, or other optical effects which are larger than the optical aperture and may allow movement across or through the beam to produce effects such as rainfall or fire. Such devices are often termed animation wheels and may be included in addition to gobos so as to further modify the light beam. FIG. 1 illustrates a multiparameter automated luminaire system 10. These systems commonly include a plurality of multiparameter automated luminaires 12 which typically each contain on-board a light source (not shown), light modulation devices, electric motors coupled to mechanical drive systems, and control electronics (not shown). In addition to being connected to mains power either directly or through a power distribution system (not shown), each luminaire 12 is connected is series or in parallel to data link 14 to one or more control desks 15. The automated luminaire system 10 is typically controlled by an operator through the control desk 15.

FIG. 2 illustrates an automated luminaire 12. A lamp 21 contains a light source 22 which emits light. The light is reflected and controlled by reflector 20 through an aperture or imaging gate 24 and through an animation wheel 25. The resultant light beam may be further constrained, shaped, colored, and filtered by optical device 26 which may include dichroic color filters, gobos, rotating gobos, framing shutters, effects glass, and other optical devices well known in the art. The final output beam may be transmitted through output lenses 28 and 31 which may form a zoom lens system.

FIG. 3 illustrates a prior art gobo wheel 1 containing five gobos 3 and an open aperture 4. The gobo wheel 1 may be rotated, as shown by arrow 5, such that any of the gobos 3 may be positioned across the optical aperture of the luminaire 12.

FIG. 4 illustrates a further prior art gobo wheel 6. In this version the gobos 8 are contained within carriers 2 that may be rotated through gears. The gobo wheel 6 may be rotated such that any of the gobo carriers 2 containing a gobo 8 are positioned across an optical aperture of the luminaire and said selected gobo carrier 2 may then be rotated around the optical axis of the luminaire producing a dynamic effect in the output beam.

In both examples, to change gobos from a first gobo to a second, non-adjacent gobo requires that the wheel be rotated through all the gobos in between the first and second gobos. It would be advantageous if a gobo system could change from a first gobo to any second gobo without having to pass through intermediate gobos.

In addition, it would be advantageous if gobos larger than the optical aperture could be inserted and removed from the optical aperture in any position or orientation. It would further be advantageous if two serially mounted gobos could be inserted and removed from the optical aperture such that overlay and moiré effects could be created.

BRIEF DESCRIPTION OF THE DRAWINGS

For a more complete understanding of the present invention and the advantages thereof, reference is now made to the following description taken in conjunction with the accompanying drawings in which like reference numerals indicate like features and wherein.

DETAILED DESCRIPTION OF THE INVENTION

Preferred embodiments of the present invention are illustrated in the FIGUREs, like numerals being used to refer to like and corresponding parts of the various drawings.

The present invention generally relates to an automated luminaire, specifically to the configuration of a graphic wheel within such a luminaire such that gobos larger than the optical aperture may be utilized, such that serially mounted gobos may be overlaid, and such that selection may be made between any two gobos, adjacent or non-adjacent, without the need to pass through intermediate gobos.

Figure 5:
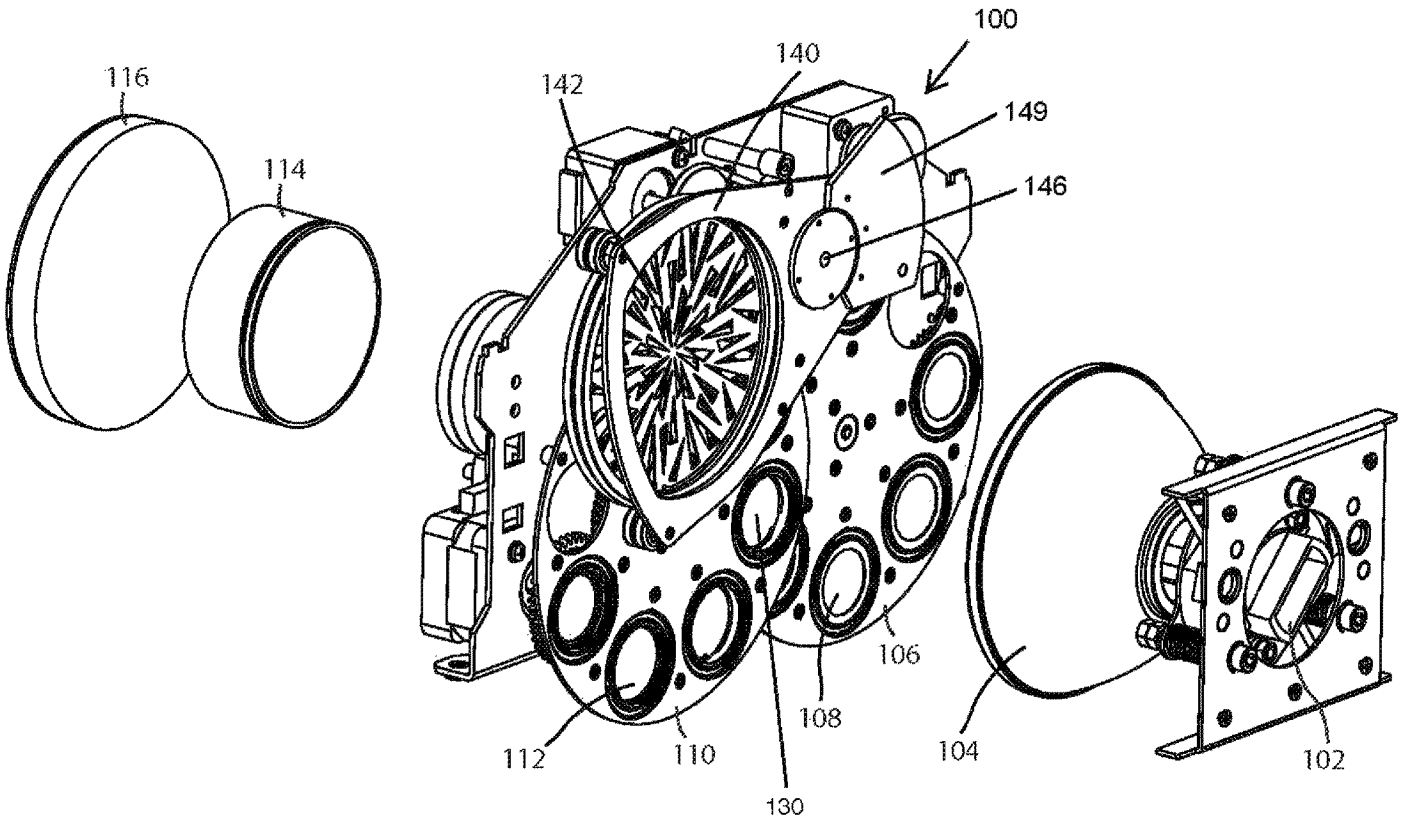
FIG. 5 illustrates an embodiment of the positioning of the dual wheel among other light modulators in an automated luminaire.

FIG. 5 illustrates an embodiment of the positioning of the dual wheel among other light modulators in an automated luminaire. Lamp 102 is mounted within reflector 104 and directs a light beam through prior art rotating gobo wheels 106 and 110. Rotating gobo wheel 106 may be rotated such that any of the gobos 108 are positioned across the optical aperture and rotating gobo wheel 110 may be rotated such that any of the gobos 112 are positioned across the optical aperture 130. The resultant light beam is directed through output lenses 114 and 116 which may be adjusted so as to move the focal point of the system such that any optical component is in focus in the output beam. A dual graphic wheel 100 includes a carrier plate 140 which carries the graphic wheels 142 and 143 (143 not identified in this view). Carrier plate 140 may be rotated about axis 146 such that graphic wheel 142 is positioned across the optical aperture 130 of the luminaire. In the position illustrated in FIG. 5, graphic wheel 142 is outside of the optical path and not across the optical aperture 130.

Figure 1:
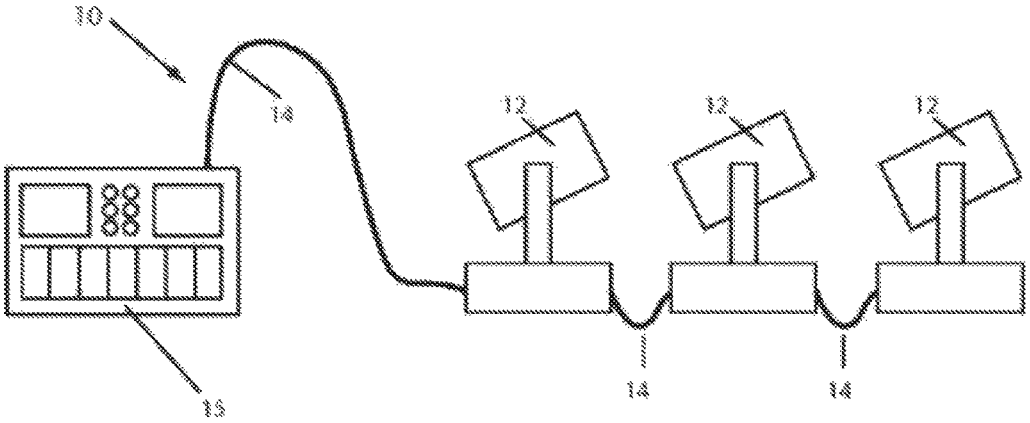
FIG. 1 illustrates a typical automated lighting system.
Figure 2:
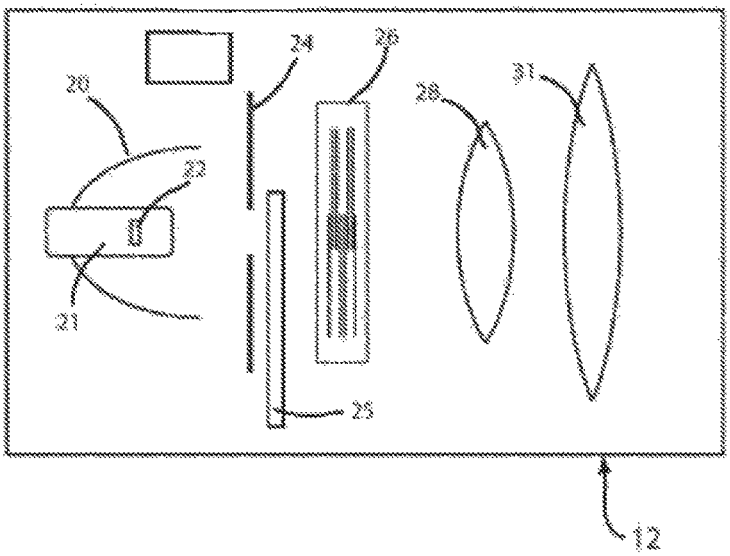
FIG. 2 illustrates a typical automated luminaire.
Figure 3:
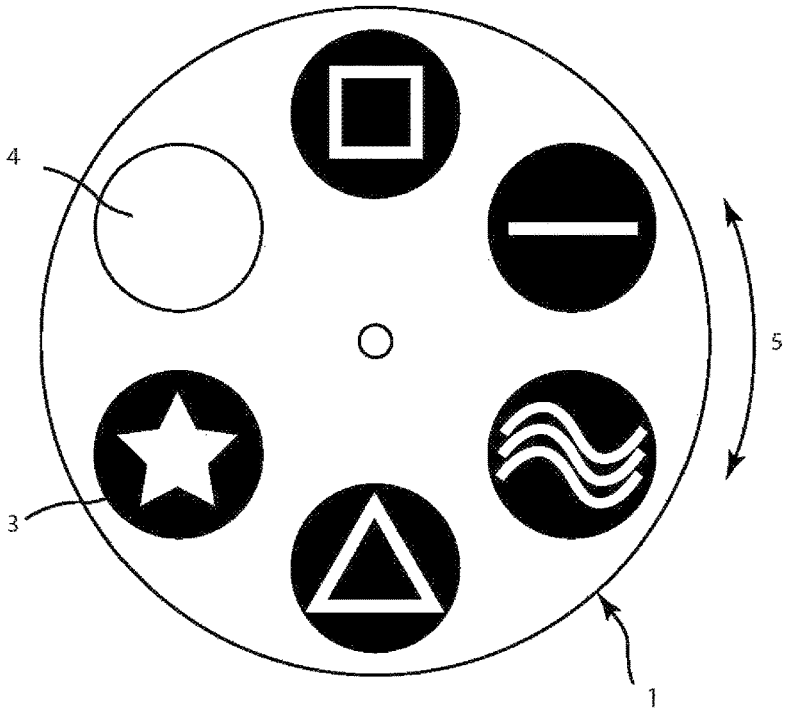
FIG 3 (prior art)
FIG. 3 illustrates a prior art gobo wheel.
Figure 4:
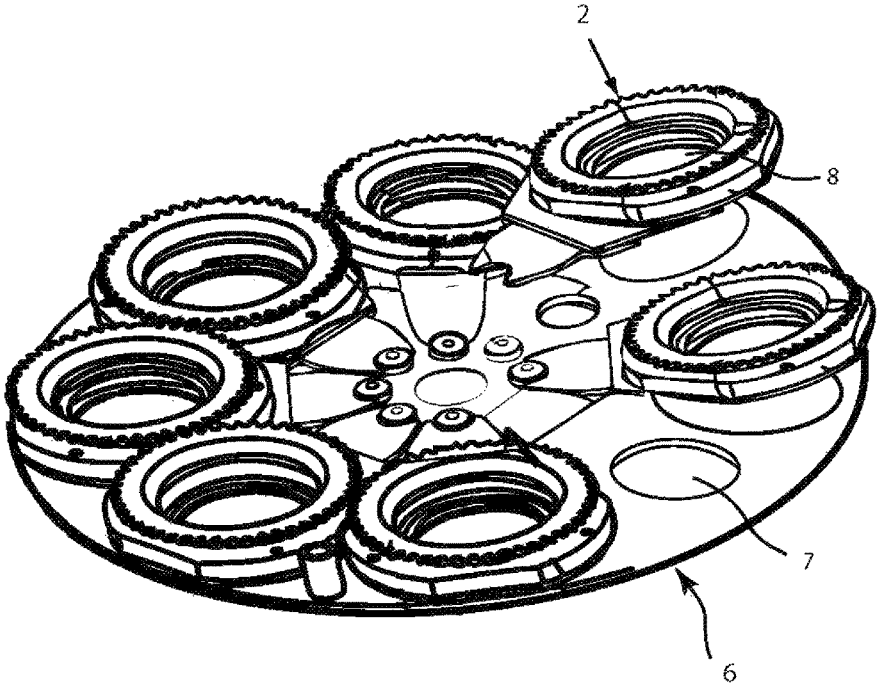
FIG 4 (prior art)
FIG. 4 illustrates a prior art rotating gobo wheel.

FIGS. 6*a-d* illustrate various operational positions of the dual wheel. Graphic wheel carrier plate 140 contains a graphic wheel 142. Graphic wheel 142 may be a single pattern or incorporate multiple patterns and may be replaceable on carrier plate 140. Carrier plate 140 may be rotated, as shown by arrow 147, around pivot axis 146 such that graphic wheel 142 is moved across the optical aperture 130 of the luminaire. Graphic wheel 142 may be substantially larger than the optical aperture 130. In the embodiment shown, the diameter of the graphic wheel 142 is over three times the diameter of the optical aperture 130. Other relative sizes are also possible but for the desired effect and functionality the relative size should be substantially larger than the relative size of the gobos in the prior art gobo wheels illustrated in FIG. 3 and FIG. 4. Carrier plate 140 may have a counterweight 149 such that the assembly is substantially balanced around axis 146.

Figure 6A:
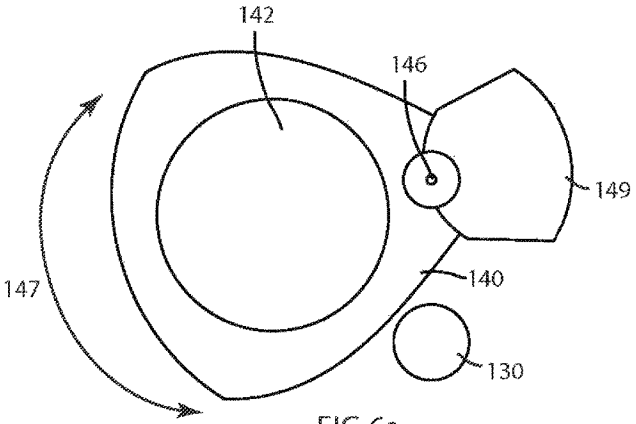
FIGS. 6*a-d* illustrate various operational positions of the dual wheel.

FIG. 6*a* shows carrier plate 140 positioned such that graphic wheel 142 is outside the optical aperture 130 and thus has no effect on the projected light beam.

Figure 6C:
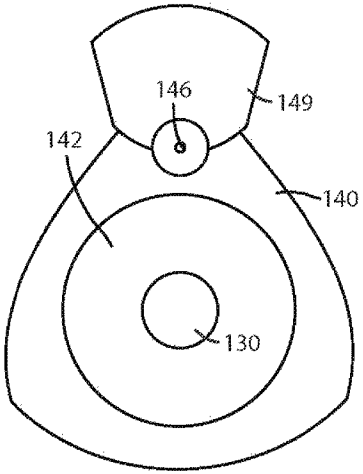
Figure 6B:
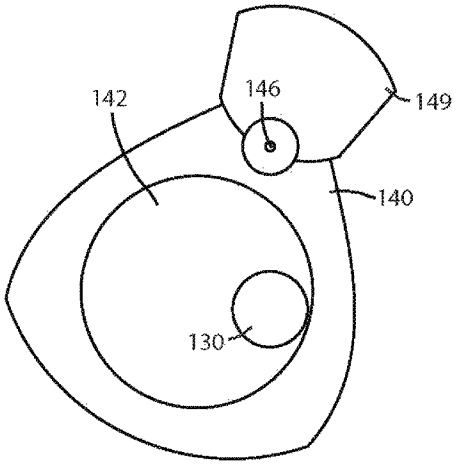

FIG. 6*b* shows carrier plate 140 positioned such that graphic wheel 142 is across the optical aperture 130. In this position the focus mechanism of the luminaire may be adjusted such that the patterns or images on graphic wheel 142 are in focus in the projected image or are out of focus in the projected image. The edge of graphic wheel 142 is adjacent to optical aperture 130 such that graphic wheel 142 may be rotated around its centre point (not identified) to provide an arc movement of the pattern across the optical aperture 130.

FIG. 6*c* shows carrier plate 140 positioned such that graphic wheel 142 is across the optical aperture 130. In this position the focus mechanism of the luminaire may be adjusted such that the patterns or images on graphic wheel 142 are in focus in the projected image or are out of focus in the projected image. The centre of graphic wheel 142 is coincident/concentric with the centre of optical aperture 130 such that graphic wheel 142 may be rotated around its centre point to provide a rotation movement of the pattern around the centre of the optical aperture 130.

Figure 6D:
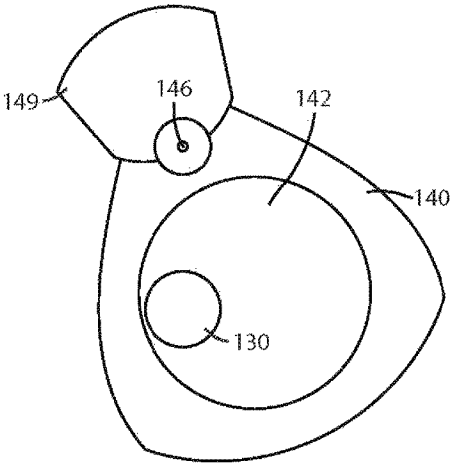

FIG. 6*d* shows carrier plate 140 positioned such that graphic wheel 142 is across the optical aperture 130. In this position the focus mechanism of the luminaire may be adjusted such that the patterns or images on graphic wheel 142 are in focus in the projected image or are out of focus in the projected image. The edge of gobo 142 is adjacent to optical aperture 130 such that graphic wheel 142 may be rotated around its centre point to provide a movement of the pattern across the optical aperture 130. Graphic wheel 142 is positioned such that the opposite edge to the position illustrated in FIG. 6*b* is across the optical aperture 130. Thus, for the same rotation direction of graphic wheel 142, arc movement of the pattern across the optical aperture 130 will be in the opposite direction.

Although three positions have been illustrated, the invention is not so limited and graphic wheel carrier plate 140 may be positioned by rotation around axis 146 such that any portion of graphic wheel 142 defined by an arc drawn around axis 146 may be placed across optical aperture 130.

Figure 7:
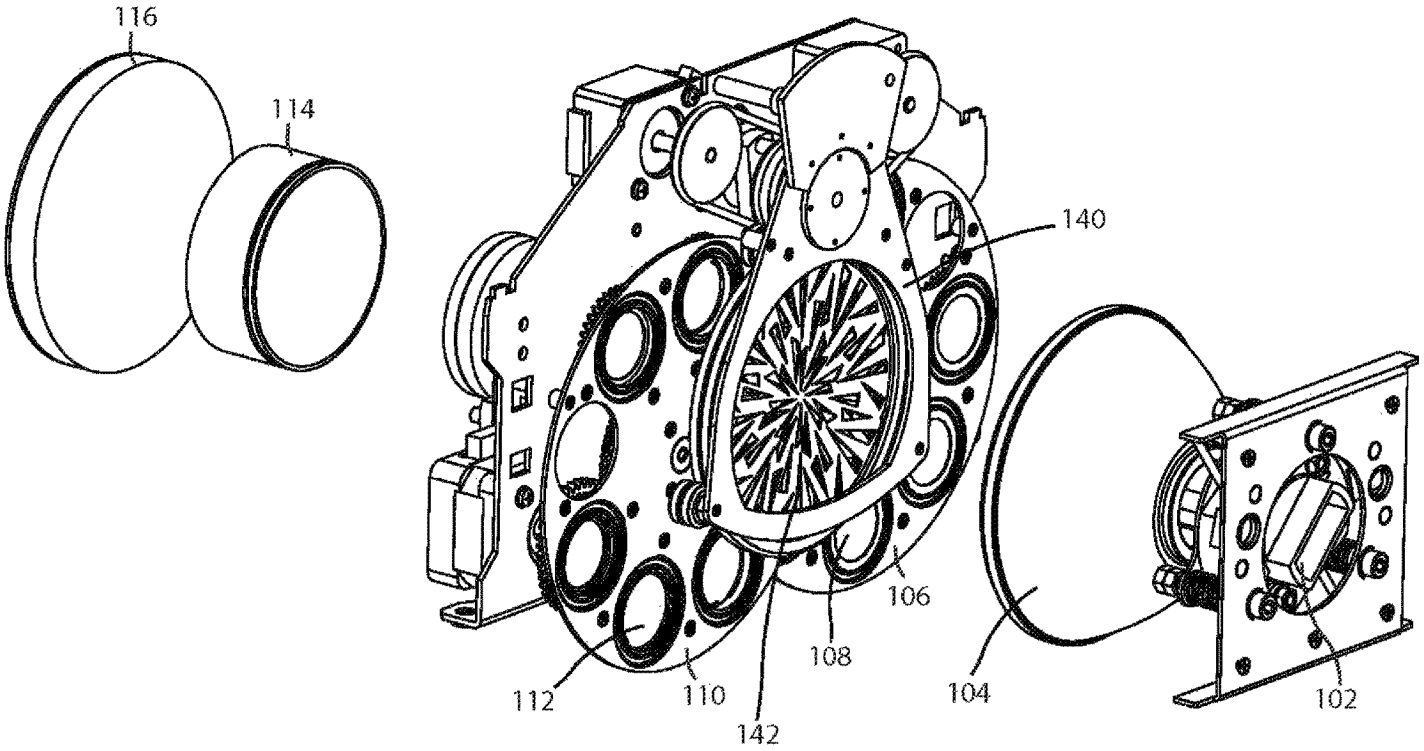
FIG. 7 illustrates an embodiment of FIG. 5 with the dual wheel in another position.

FIG. 7 illustrates an embodiment of FIG. 5 with the dual wheel in another position. Lamp 102 is mounted within reflector 104 and directs a light beam through gobos in rotating gobo wheels 106 and 110. Rotating gobo wheel 106 may be rotated such that any of the gobos 108 are positioned across the optical aperture and rotating gobo wheel 110 may be rotated such that any of the gobos 112 are positioned across the optical aperture. The resultant light beam is directed through output lenses 114 and 116 which may be adjusted so as to move the focal point of the system such that any optical component is in focus in the output beam. Graphic wheel carrier plate 140 may be rotated such that graphic wheel 142 is positioned across the optical aperture of the luminaire. In the position illustrated in FIG. 7 graphic wheel 142 is inside the optical path and is positioned across the optical aperture (not seen in FIG. 7). In this position output lenses 114 and 116 may be adjusted such that any of the optical elements including gobo wheel 106, gobo wheel 110, and graphic wheel 142 are in focus in the output beam.

Figure 8:
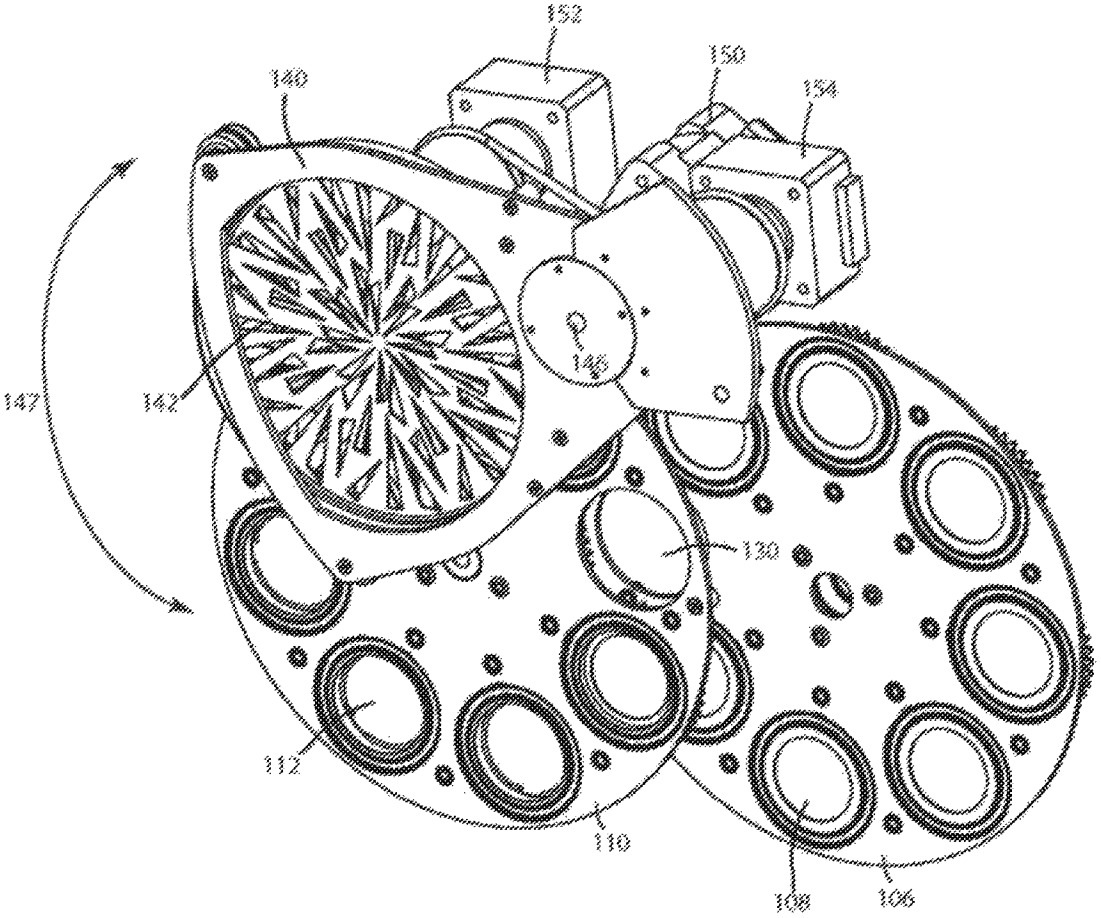
FIG. 8 illustrates alternative viewing of positioning of components of the embodiment illustrated in FIG. 5.

FIG. 8 illustrates a more detailed view of an embodiment of the invention. Rotating gobo wheel 106 may be rotated such that any of the gobos 108 are positioned across the optical aperture 130 and rotating gobo wheel 110 may be rotated such that any of the gobos 112 are positioned across the optical aperture 130. Graphic wheel carrier plate 140 may be rotated, as shown by arrow 147, by motor 150 around axis 146 such that graphic wheel 142 is positioned across the optical aperture 130 of the luminaire. In the position illustrated in FIG. 8 graphic wheel 142 is outside of the optical path and not across the optical aperture 130.

Figure 9:
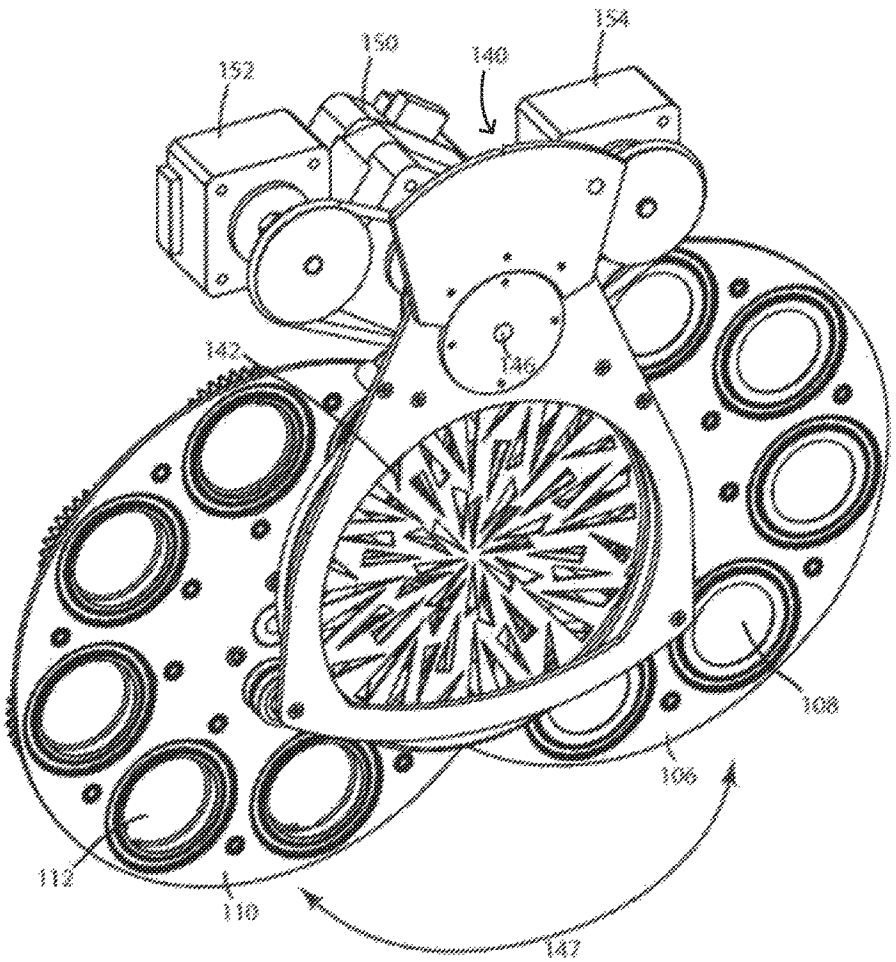
FIG. 9 illustrates alternative viewing of positioning of components of the embodiment illustrated in FIG. 7.

FIG. 9 illustrates the same system depicted in FIG. 8 showing a situation where graphic wheel carrier plate 140 has now been rotated, as shown by arrow 147, by motor 150 around axis 146 such that graphic wheel 142 is positioned across the optical aperture (not seen in FIG. 9) of the luminaire. In this position light will travel through graphic wheel 142 as well as gobos on rotating gobo wheels 106 and 110. Further, graphic wheel 142 may be rotated, as shown by arrow 147, around its own centre by motor 154 as further described below.

Figure 10:
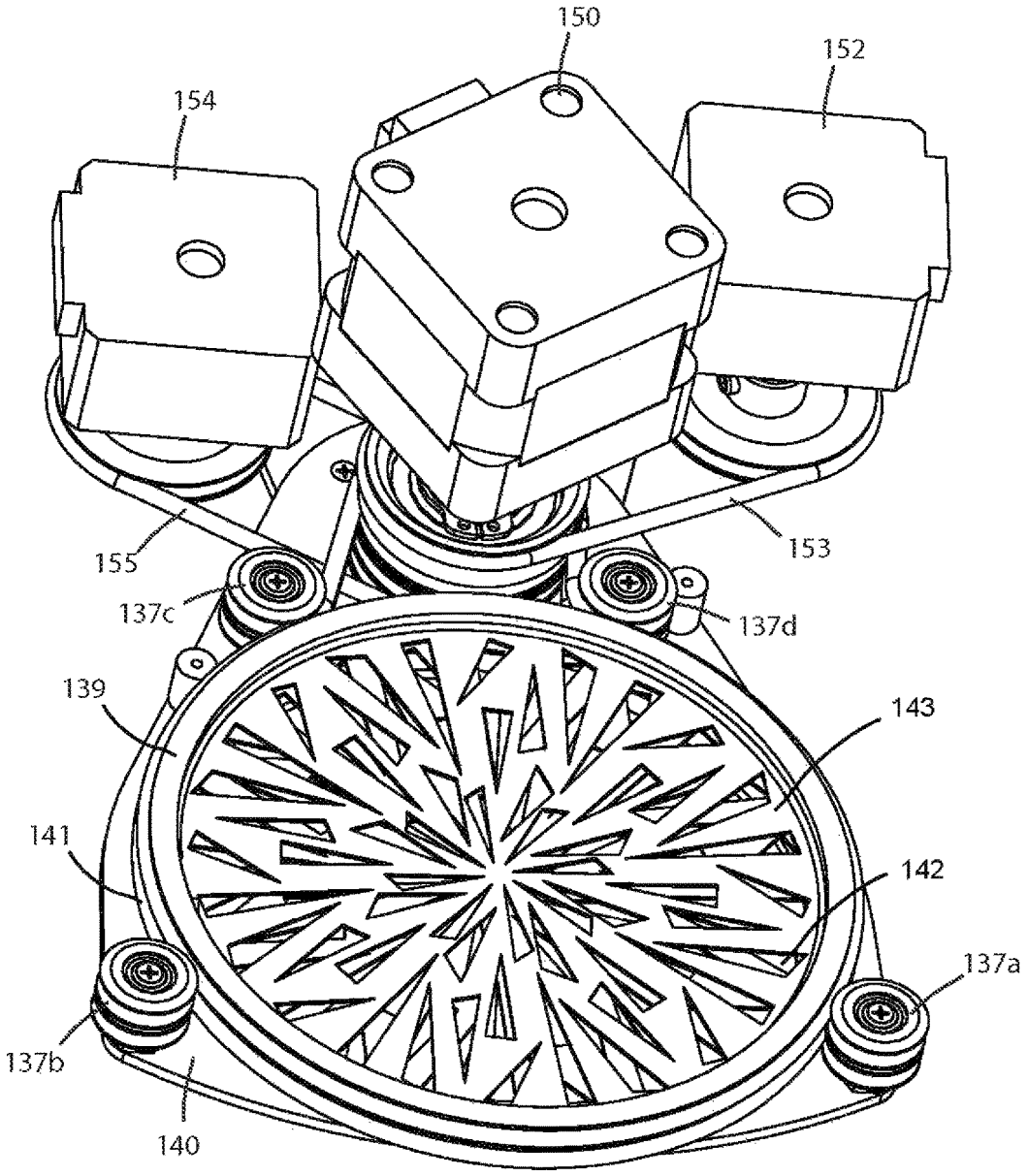
FIG. 10 illustrates an embodiment of the drive system of the dual graphics wheel.

FIG. 10 illustrates a detailed backside view of the graphic wheel mechanism of an embodiment of the invention. In this embodiment graphic wheel carrier plate 140 carries two serially mounted, concentric graphic wheels 143 and 142. Graphic wheel 143 is mounted within rim 139 and graphic wheel 142 is mounted within rim 141. Graphic wheels 143 and 142 are concentric and will move together with carrier plate 140 such that both of them will be moved across the optical aperture together. Rim 139 and rim 141 are constrained by, but free to rotate within, dual bearings 137*a*, 137*b*, 137*c* and 137*d*. Each dual bearing 137*a*, 137*b*, 137*c* and 137*d* allows individual rotation of rim 139 from rotation of rim 141. Rim 139, and thus contained graphic wheel 143, is connected by belt 153 to motor 152. Similarly rim 141, and thus contained graphic wheel 142, is connected by belt 155 to motor 154. Rotation of motor 152 will cause rotation of rim 139 and contained graphic wheel 143. Rotation of motor 154 will cause rotation of rim 141 and contained graphic wheel 142. Rotation of motor 150 will rotate the carrier plate 140 across or away from the optical aperture as previously described. Motors 150, 152 and 154 may be of a type selected from a list comprising, but not limited to, stepper motors, servo motors, and linear actuators.

Through this mechanism, by coordinated and separate adjustment of motors 150, 152 and 154, carrier plate 140 and attached graphic wheels 142 and 143 may be positioned such that the desired area of graphic wheels 142 and 143 are positioned across the optical aperture. Once in position either or both of graphic wheels 142 and 143 may be independently and separately rotated about its own centre point. Graphic wheels 142 and 143 may contain the same pattern or different patterns. The patterns may be chosen such that the movement of graphic wheel 142 relative to graphic wheel 143 produces moiré, kaleidoscopic, or other interference effects. Such effects may be produced independently or in conjunction with gobos on prior art gobo or rotating gobo wheels or other optical devices in the luminaire as well known in the art.

Figure 11:
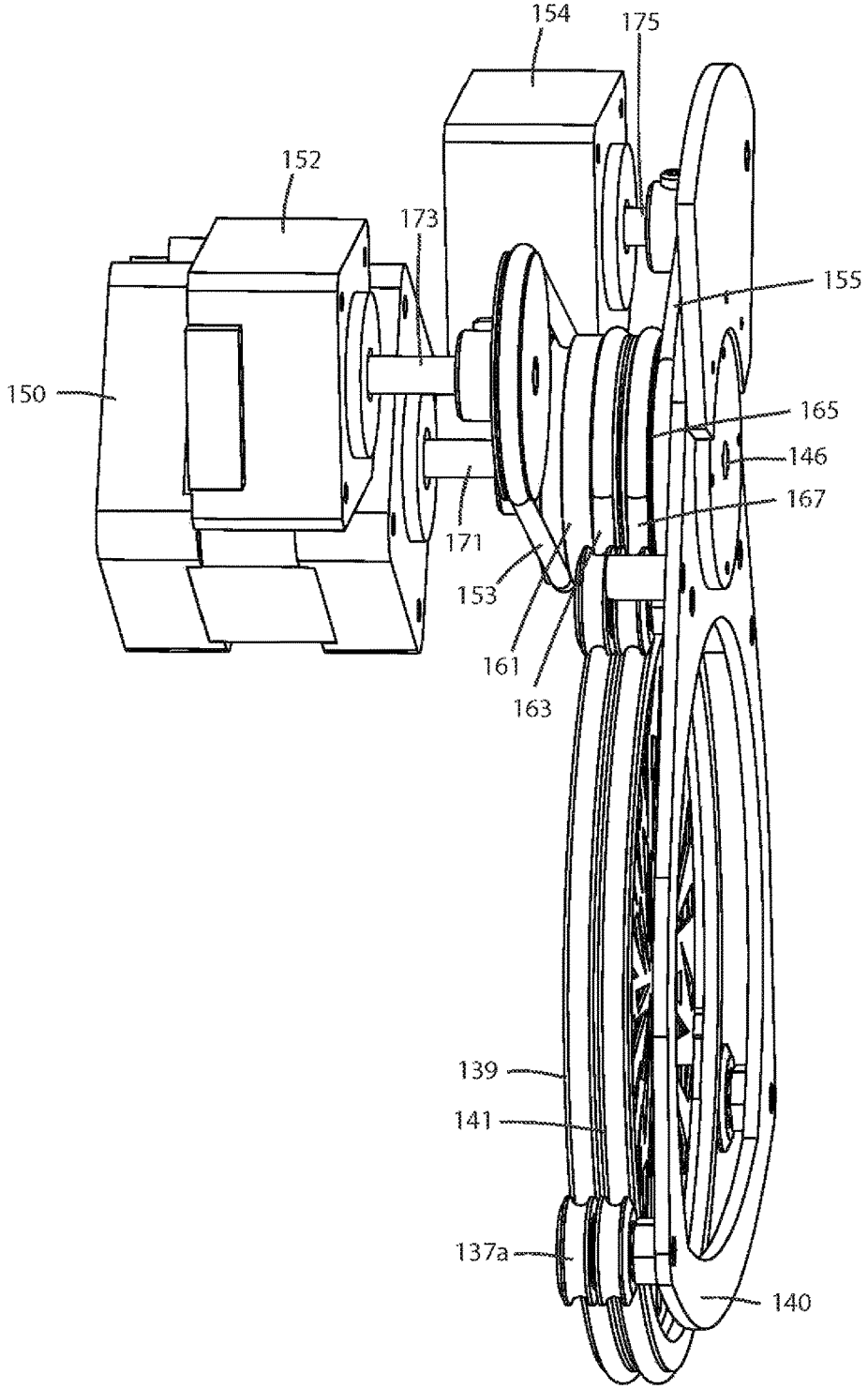
FIG. 11 illustrates a slightly offset view of the drive system embodiment illustrated in FIG. 10.

FIG. 11 illustrates a slightly offset view of the drive system for the graphic wheels 143 and 142 illustrated in FIG. 10. The rotation of carrier plate 140 is driven by motor 150 via shaft 171 about axis 146. Shaft 171 also supports idler pulleys 161 and 165 but does not impede rotation of the idler pulleys 161 and 165. Idler pulley 161 has two grooves for accepting drive belts 153 and 163. While idler pulley 165 has two grooves for accepting drive belts 167 and 155. In this way, drive belts 163 and 167, which drive rotation of the rims 139 and 141 respectively, which in turn rotate graphic wheels 143 and 142 respectively, are right next to each other so that the graphic wheels 142 and 143 are right next to each other. Rotation of rim 139 and graphic wheel 143 is driven by motor 152 which rotates shaft 173 which drives belt 153 which rotates idler pulley 161 which drives belt 163. Rotation of rim 141 and graphic wheel 142 is driven by motor 154 which rotates shaft 175 which drives belt 155 which rotates idler pulley 165 which drives belt 167. The rims 139, 141 are held in place by dual idler bearings 137*a*, 137*b* (not identified in FIG. 11, 137*d* (not identified in FIG. 11) and 137*c* (not seen in FIG. 11) as previously described above.

Figure 12:
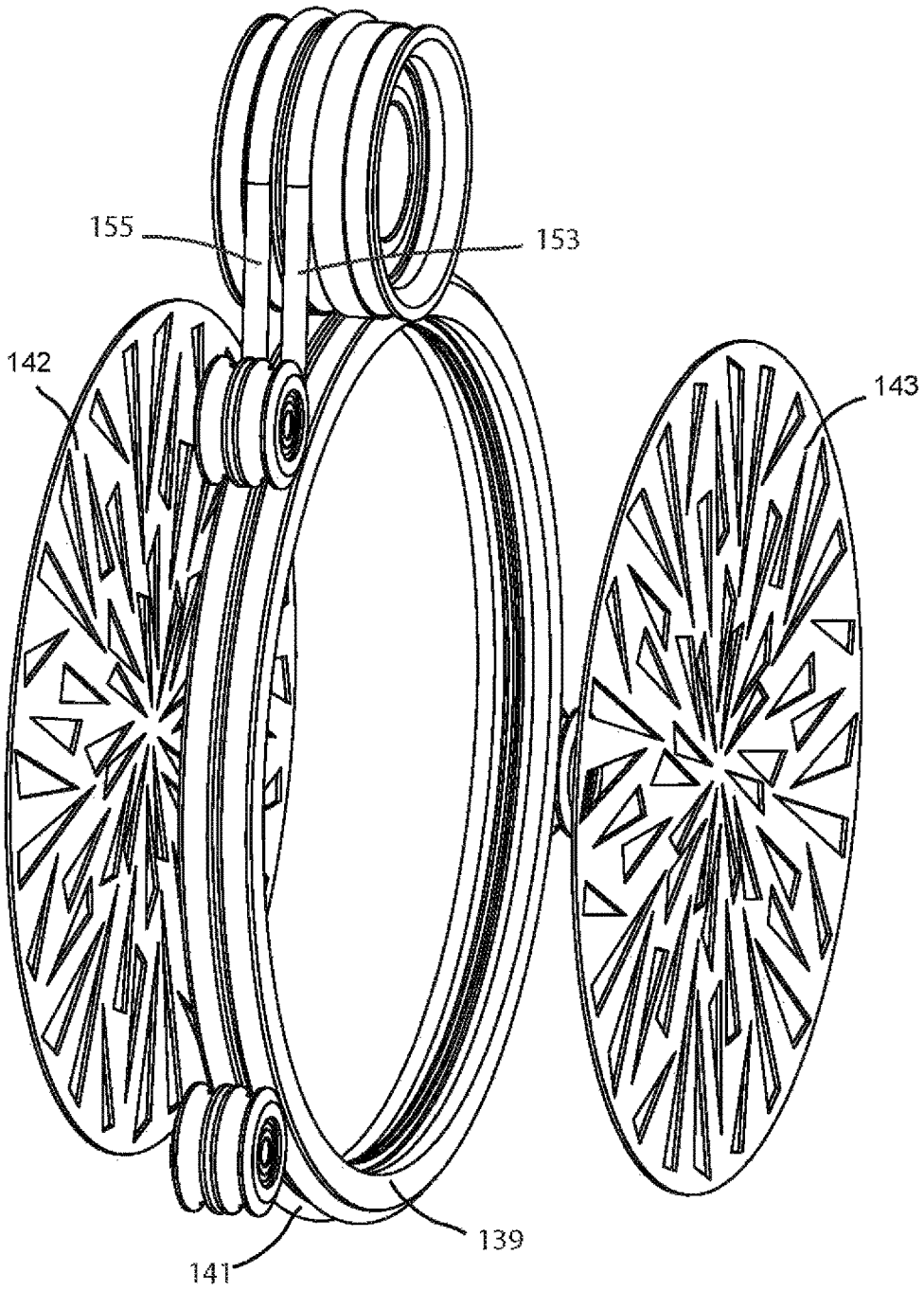
FIG. 12 illustrates an embodiment of a subset of the components of the embodiment illustrated in FIG. 10.

FIG. 12 illustrates an exploded view of an embodiment of the invention. Graphic wheel 142 mounts within first rim 141 which may be rotated about its centre point by first belt 153. Graphic wheel 143 mounts within second rim 139 which may be rotated about its centre by second belt 155. Graphic wheels 142 and 143 may be easily removed and replaced such that the user can change the effect produced.

FIG. 12 illustrates an embodiment of the invention where graphic wheels 143 and 142 have patterns that provide a moiré or kaleidoscopic effect.

Figure 13:
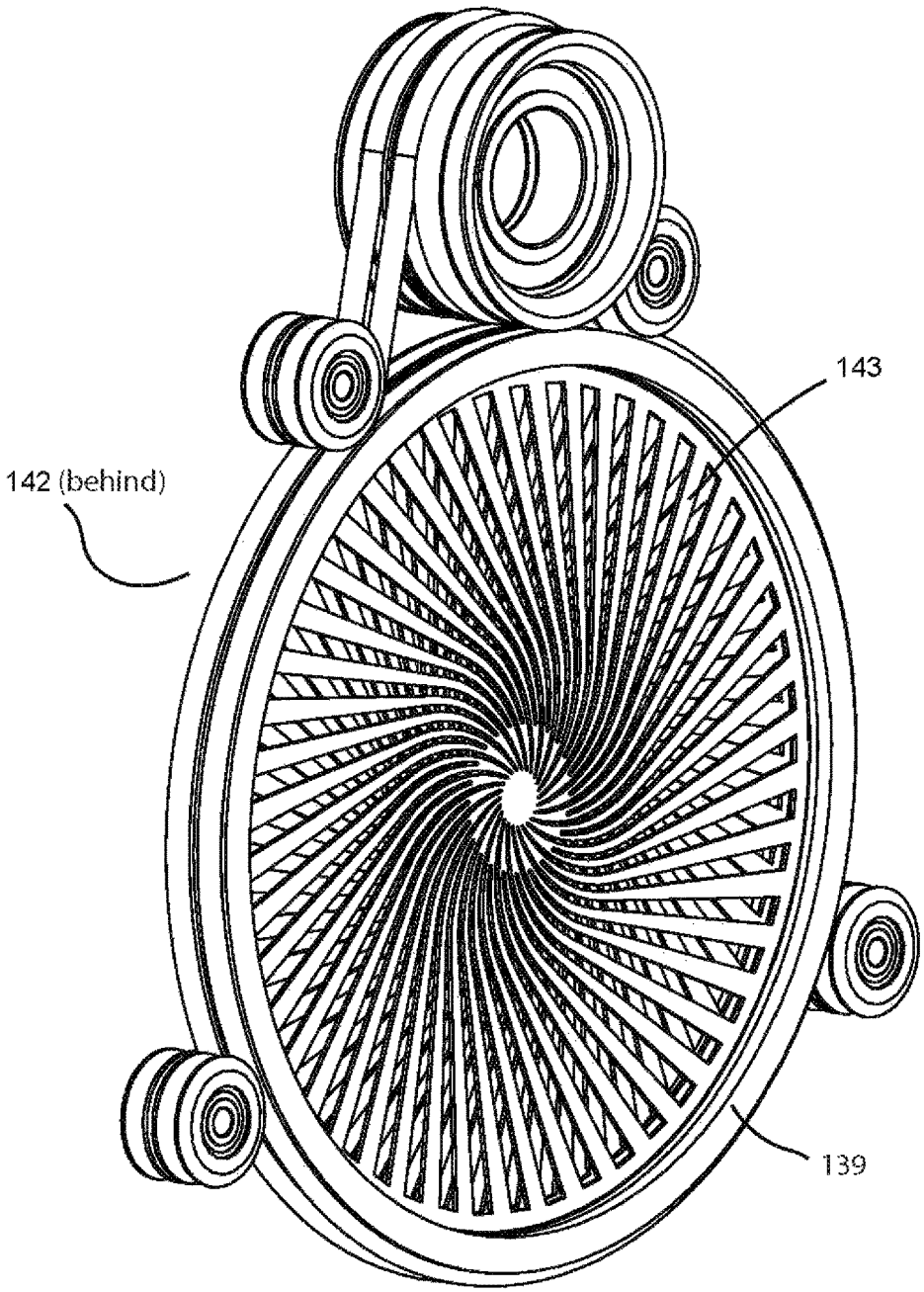
FIG. 13 illustrates an alternative embodiment of the graphic wheels.
Figure 14:
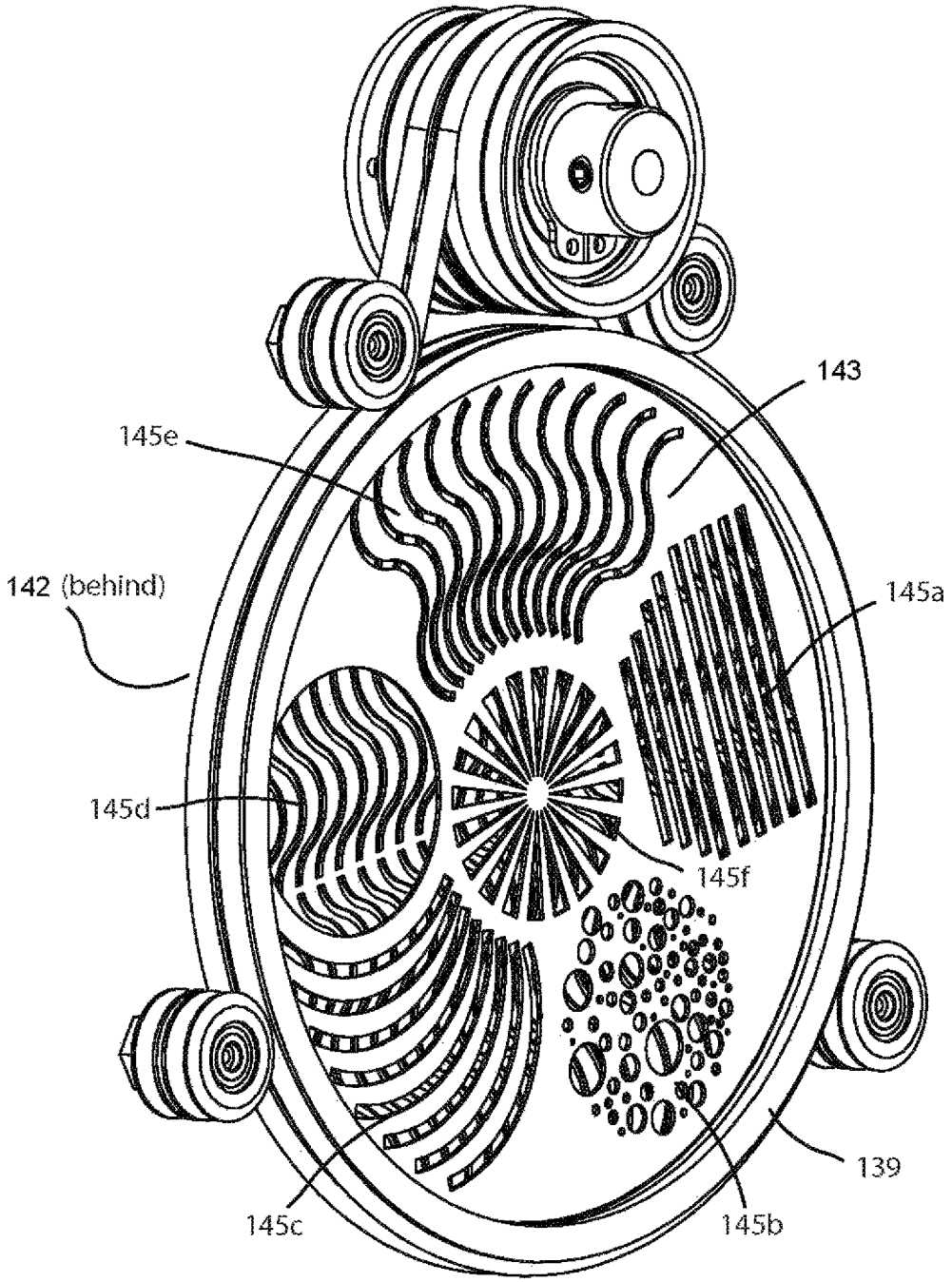
FIG. 14 illustrates another alternative embodiment of the graphic wheels.

FIGS. 13 and 14 illustrate the reverse and obverse views of an embodiment of the invention. In this embodiment graphic wheel 143 contains a plurality of smaller patterns within it, 145*a*, 145*b*, 145*c*, 145*d*, 145*e*, and 145*f*. By coordinated and separate adjustment of the motors first graphic wheel 143 may be positioned and rotated such that any of the smaller patterns 145*a*, 145*b*, 145*c*, 145*d*, 145*e*, or 145*f* is positioned across the optical aperture of the luminaire. In such position the graphic wheel 142 may contain a break up pattern as illustrated herein. By altering the focal position of the optical system the user can superimpose or overlay this break up pattern over the pattern from graphic wheel 143. By rotating graphic wheel 142 an effect may be created to simulate fire or water movement. It can further be seen that by positioning graphic wheel 143 prior to moving it across the aperture it is possible to directly select any of the smaller patterns 145*a*, 145*b*, 145*c*, 145*d*, 145*e*, or 145*f* without the need to pass through any other gobos. Further, to move from a first small pattern chosen from 145*a*, 145*b*, 145*c*, 145*d*, or 145*e* to a second small pattern chosen from 145*a*, 145*b*, 145*c*, 145*d*, or 145*e*, the user may choose to either move directly to the second small pattern without concern for intervening patterns or may choose to first remove graphic wheel 143 from the optical aperture using motor 150 before continuing to select a second small pattern. Thus, the operator has complete control over the route taken from a first pattern to a second pattern.

The specific mechanism illustrated herein using belts and bearings is illustrative only and not a limitation of the invention. Other mechanisms well known in the art to move carrier plate 140 and rotate graphic wheel 143 and graphic wheel 142 may be used without departing from the spirit of the invention.

In further embodiments, either or both of first and second graphic wheels 143 and 142 may comprise a piece of optical filter glass with, for example, lenticular lens pattern or prisms. Rotation of such a filter by motors 152 or 154 will cause a rotation of the optical effect caused by the optical filter glass.

In further embodiments, the separation along the optical axis of the first gobo wheel, second gobo wheel and rotating gobo wheels may be minimized such that the optical system can focus on more than one of these optical elements at the same time.

In a further embodiment, software in the automated luminaire may provide automated or semi-automated selection of motor control parameters, such that a single control selection by the user will recall combinations of positions of the rotating gobo wheels, graphic wheel carrier plate, first gobo rotation position, second gobo rotation position, and other optical component parameters in order to provide a pleasing pre-defined effect. The user may then switch between many complex pre-defined effects through operation of this single control.

While the invention has been described with respect to a limited number of embodiments, those skilled in the art, having benefit of this invention, will appreciate that other embodiments may be devised which do not depart from the scope of the invention as disclosed herein. Accordingly, the scope of the invention should be limited only by the attached claims.

What is claimed is:

1. An automated luminaire comprising:

a plurality of light modulating wheels, concentrically mounted on a carrier, the carrier comprising a plurality of bearings configured to mechanically couple to the light modulating wheels at their respective rims, where the carrier is configured to (i) independently rotate the light modulating wheels about their centers, (ii) move the light modulating wheels together into a light beam of the automated luminaire, and (iii) move the light modulating wheels together completely out of the light beam.

2. The automated luminaire of claim 1, wherein the carrier is configured to drive the independent rotation of the light modulating wheels at their respective rims.

3. The automated luminaire of claim 1, wherein the carrier is configured to rotate to a first position, where the light modulating wheels are completely out of the light beam, and to a second position, where the light beam passes through first portions of the light modulating wheels.

4. The automated luminaire of claim 3, wherein:

the light beam has a first diameter and the light modulating wheels have a common second diameter, where the second diameter is larger than the first diameter;

the first portions of the light modulating wheels include a center of each of the light modulating wheels; and the carrier is configured to move the light modulating wheels to a third position, where the light beam passes through second portions of the light modulating wheels, the second portions of the light modulating wheels adjacent to first edge portions of the light modulating wheels.

5. The automated luminaire of claim 4, wherein the second diameter is at least three times as large as the first diameter and the carrier is configured to move the light modulating wheels to a fourth position where the light beam passes through third portions of the light modulating wheels, the third portions of the light modulating wheels adjacent to second edge portions of the light modulating wheels, the second edge portions of the light modulating wheels located on an opposite side of the light modulating wheels from the first edge portions of the light modulating wheels.

6. The automated luminaire of claim 1, further comprising a gobo wheel configured to position a selected one of a plurality of gobos in the light beam.

7. The automated luminaire of claim 6, wherein the gobo wheel is configured to rotate the selected gobo while the selected gobo is positioned in the light beam.

8. The automated luminaire of claim 1, where a first light modulating wheel of the plurality of light modulating wheels comprises a plurality of patterns, the carrier configured to rotate the first light modulating wheel to position a selected one of the plurality of patterns in the light beam.

9. The automated luminaire of claim 8, where the carrier is configured to rotate a second light modulating wheel of the plurality of light modulating wheels continuously while the first light modulating wheel is positioned with the selected one of the plurality of patterns in the light beam.

10. A multiparameter automated luminaire, comprising:

a light source configured to emit a first light beam;

a plurality of optical elements optically coupled to the light source and configured to receive the first light beam and to emit a second light beam, the plurality of optical elements including a dual graphic wheel system, the dual graphic wheel system comprising two light modulating wheels, concentrically mounted on a carrier, where the carrier is configured to (i) independently rotate the two light modulating wheels about their centers, (ii) move the two light modulating wheels together into the first light beam, and (iii) move the two light modulating wheels together completely out of the first light beam;

an output lens, optically coupled to the dual graphic wheel system, the output lens configured to receive the second light beam and to project an image, the output lens configured to move to adjust a focus of at least one of the plurality of optical elements in the projected image.

11. The multiparameter automated luminaire of claim 10, wherein the carrier comprises a plurality of bearings configured to mechanically couple to the light modulating wheels at their respective rims.

12. The multiparameter automated luminaire of claim 11, wherein the carrier is configured to drive the independent rotation of the light modulating wheels at their respective rims.

13. The multiparameter automated luminaire of claim 10, wherein the carrier is configured to rotate to a first position, where the two light modulating wheels are completely out of the first light beam, and to a second position, where the first light beam passes through first portions of the two light modulating wheels.

14. The multiparameter automated luminaire of claim 13, wherein:

the first light beam has a first diameter and the two light modulating wheels have a common second diameter, where the second diameter is larger than the first diameter;

the first portions of the two light modulating wheels include a center of each of the light modulating wheels; and the carrier is configured to move the two light modulating wheels to a third position, where the first light beam passes through second portions of the two light modulating wheels, the second portions of the two light modulating wheels adjacent to first edge portions of the two light modulating wheels.

15. The multiparameter automated luminaire of claim 14, wherein the second diameter is at least three times as large as the first diameter and the carrier is configured to move the two light modulating wheels to a fourth position where the first light beam passes through third portions of the two light modulating wheels, the third portions of the two light modulating wheels adjacent to second edge portions of the two light modulating wheels, the second edge portions of the two light modulating wheels located on an opposite side of the two light modulating wheels from the first edge portions of the two light modulating wheels.

16. The multiparameter automated luminaire of claim 10, wherein the plurality of optical elements further comprises a gobo wheel configured to position a selected one of a plurality of gobos in the first light beam.

17. The multiparameter automated luminaire of claim 16, wherein the gobo wheel is configured to rotate the selected gobo while the selected gobo is positioned in the first light beam.

18. The multiparameter automated luminaire of claim 10, where a first one of the two light modulating wheels comprises a plurality of patterns, the carrier configured to rotate the first light modulating wheel to position a selected one of the plurality of patterns in the first light beam.

19. The multiparameter automated luminaire of claim 18, where the carrier is configured to rotate the second light modulating wheel of the two light modulating wheels continuously while the first light modulating wheel is positioned with the selected one of the plurality of patterns in the light beam.

* * * * *